US008156573B2

(12) United States Patent
Gandy

(10) Patent No.: US 8,156,573 B2
(45) **Date of Patent: *Apr. 17, 2012**

(54) GARMENT WITH DEPLOYABLE HOOD AND METHOD FOR USING SAME

(75) Inventor: Mark Gandy, Calabasas Hills, CA (US)

(73) Assignee: Helmet House, Inc., Calabasas Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/854,004

(22) Filed: Aug. 10, 2010

(65) Prior Publication Data

US 2010/0325771 A1 Dec. 30, 2010

Related U.S. Application Data

(62) Division of application No. 11/831,874, filed on Jul. 31, 2007, now Pat. No. 7,779,485.

(51) Int. Cl.
*A41D 3/08* (2006.01)
*A41D 3/02* (2006.01)

(52) U.S. Cl. ..... 2/84; 2/98

(58) Field of Classification Search ..... 2/468, 410, 2/60, 84, 85, 86, 87, 88, 89, 93, 94, 98, 100, 2/129, 116, 202

See application file for complete search history.

(56) References Cited

U.S. PATENT DOCUMENTS

| | | | | |
|---|---|---|---|---|
| 774,703 | A | 11/1904 | Scott | |
| 1,097,530 | A | 5/1914 | Cabelinksy | |
| 1,525,322 | A | 2/1925 | Post | |
| 1,899,487 | A * | 2/1933 | Walsh | 2/98 |
| 1,980,394 | A | 11/1934 | Falcon | |
| 2,102,251 | A | 12/1937 | Arst | |
| 2,129,454 | A | 9/1938 | Wilkie | |
| 2,150,171 | A | 3/1939 | Kolly | |
| 2,160,682 | A | 5/1939 | Silber | |
| 2,264,314 | A | 12/1941 | Johns | |
| 2,272,959 | A | 2/1942 | Van Wormer | |
| 2,500,982 | A | 3/1950 | Fligel | |
| 2,547,931 | A | 4/1951 | De Grazia | |
| 2,567,192 | A | 9/1951 | De Grazia | |
| 2,574,716 | A | 11/1951 | Spatz | |
| 2,617,106 | A * | 11/1952 | Pritzker | 2/97 |
| 2,682,056 | A | 6/1954 | Werber | |
| 2,834,966 | A | 5/1958 | Zimmerman | |
| 3,147,490 | A | 9/1964 | Allen et al. | |
| 3,389,407 | A | 6/1968 | Morrison | |
| 3,660,850 | A | 5/1972 | Garbisch | |
| 3,825,952 | A | 7/1974 | Pershing et al. | |

(Continued)

FOREIGN PATENT DOCUMENTS

| | | |
|---|---|---|
| EP | 1360909 | 12/2003 |

*Primary Examiner* — Alissa L Hoey
(74) *Attorney, Agent, or Firm* — Jeffer Mangels Butler & Mitchell LLP

(57) ABSTRACT

A garment, and methods of using the garment, including a main body portion, a collar attached to the main body portion, and a hood attached to the main body portion adjacent to the collar. The collar includes first and second flaps that define a collar pocket. The hood is moveable between a non-deployed position where it is received within the collar pocket and a deployed position where it is not received within the collar pocket.

5 Claims, 10 Drawing Sheets

U.S. PATENT DOCUMENTS

| | | | | |
|---|---|---|---|---|
| 3,858,028 | A | 12/1974 | Kerr | |
| 4,017,906 | A | 4/1977 | Bochynsky et al. | |
| 4,017,908 | A | 4/1977 | Murnane | |
| 4,034,417 | A | 7/1977 | Ellis | |
| 4,042,976 | A | 8/1977 | Reynolds | |
| 4,064,562 | A | 12/1977 | Kenny | |
| 4,573,217 | A | 3/1986 | Reed | |
| 4,602,385 | A | 7/1986 | Warren | |
| 4,887,319 | A | 12/1989 | Daniels | |
| 4,961,232 | A | 10/1990 | Hulsey | |
| 5,040,243 | A | 8/1991 | Tatsuno | |
| 5,077,838 | A | 1/1992 | Senser | |
| 5,090,054 | A | 2/1992 | Grilliot et al. | |
| 5,095,550 | A | 3/1992 | Perlinger | |
| 5,206,957 | A | 5/1993 | Gulick | |
| 5,245,993 | A | 9/1993 | McGrady et al. | |
| 5,274,850 | A | 1/1994 | Aldridge | |
| 5,329,641 | A | 7/1994 | Kalhous | |
| 5,369,809 | A | 12/1994 | Hall | |
| 5,400,438 | A | 3/1995 | Staff et al. | |
| 5,575,009 | A | 11/1996 | Ryvin | |
| 5,662,372 | A | 9/1997 | Lubkeman | |
| 5,845,340 | A | 12/1998 | Frislie | |
| 5,873,132 | A | 2/1999 | Grilliot et al. | |
| 5,875,493 | A | 3/1999 | MacDonald et al. | |
| 6,263,509 | B1 | 7/2001 | Bowen | |
| 6,295,652 | B1 | 10/2001 | Mazur | |
| 6,370,692 | B1 | 4/2002 | Duyn et al. | |
| 6,374,418 | B1 | 4/2002 | Rindle | |
| 6,481,018 | B2 * | 11/2002 | Gagnon et al. | 2/98 |
| 6,654,963 | B2 | 12/2003 | Fayle et al. | |
| 6,665,878 | B1 | 12/2003 | Way | |
| 6,665,881 | B2 | 12/2003 | Giggleman et al. | |
| 6,826,781 | B2 | 12/2004 | Lewis | |
| 6,829,784 | B2 | 12/2004 | Austin | |
| 6,862,749 | B1 | 3/2005 | Krause | |
| 6,874,162 | B2 | 4/2005 | Boezi | |
| 7,028,345 | B2 | 4/2006 | Waldman | |
| 7,152,252 | B2 | 12/2006 | Gellis et al. | |
| 7,418,740 | B2 | 9/2008 | Anderson et al. | |
| 2002/0095712 | A1 | 7/2002 | Fayle et al. | |
| 2004/0019957 | A1 | 2/2004 | Lewis et al. | |
| 2005/0108804 | A1 | 5/2005 | Bush | |
| 2005/0160514 | A1 | 7/2005 | Flaniken | |
| 2005/0166303 | A1 | 8/2005 | Aaron | |
| 2006/0130213 | A1 | 6/2006 | Mickle | |
| 2006/0288468 | A1 | 12/2006 | Jorgenson | |
| 2008/0282453 | A1 | 11/2008 | Alstin et al. | |
| 2010/0212061 | A1 * | 8/2010 | Luciano | 2/84 |

* cited by examiner

GARMENT WITH DEPLOYABLE HOOD AND METHOD FOR USING SAME

CROSS REFERENCE TO RELATED APPLICATIONS

This is a divisional of U.S. patent application Ser. No. 11/831,874, filed Jul. 31, 2007, now U.S. Pat. No. 7,779,845, the entirety of which is incorporated herein by reference.

FIELD OF THE INVENTION

The present invention relates to garments comprising deployable hoods, and more particularly to garments comprising deployable hoods that are contained within a collar pocket.

BACKGROUND OF THE INVENTION

Many individuals use garments having hoods, for example, to cover themselves during inclement weather. These individuals may use hoods when riding bicycles, motorcycles, skiing, firefighting, or the like. However, these hoods dangle in the back of the garment if they are not in use. This may get in the way, for example, of a bicyclist or a motorcyclist as they are riding. If the rider is wearing the hood, it may also get in the way when the rider turns his/her head.

Helmets are often worn in sports or activities requiring head protection. For example, it is common to wear a helmet while participating in motorcycling, bicycling, snowboarding, climbing and skiing. It may be advantageous to wear a hood under the helmet if protection from the weather is required. Hoods do not fit well under helmets and rain often gets into the helmet while riding.

A need exists for a hood that overcomes the problems set forth above.

SUMMARY OF THE PREFERRED EMBODIMENTS

In accordance with a first aspect of the present invention, there is provided a garment comprising a main body portion, a collar attached to the main body portion, and a hood attached to the main body portion adjacent to the collar. The collar includes first and second flaps that define a collar pocket. The hood is moveable between a non-deployed position where it is received within the collar pocket and a deployed position where it is not received within the collar pocket.

In accordance with another aspect of the present invention there is provided a method that includes the step of providing a garment that includes a main body portion having a torso portion and two arms, a collar attached to the main body portion that includes first and second flaps that define a collar pocket and each include a top edge and a bottom edge. The top edges of the flaps are attached together, and the garment includes a hood attached to the main body portion adjacent to the collar that is received in the collar pocket in a non-deployed position. The method further includes the steps of uncoupling the first flap from the hood, removing the hood from the collar pocket to a deployed position, and coupling the first flap to the second flap.

In accordance with yet another aspect of the present invention there is provided a garment that includes a main body portion, a hood attached to the main body portion, and a collar defining a collar pocket attached to the main body portion. The collar has first and second closed configurations and an open configuration. The hood is stored in the collar pocket when the collar is in the first closed position, and is removed from the collar pocket when the collar is in the open position. The hood is used when the collar is in the second closed position.

BRIEF DESCRIPTION OF THE DRAWINGS

Like numerals refer to like parts throughout the several views of the drawings.

DESCRIPTION OF THE PREFERRED EMBODIMENTS

Figure 1:
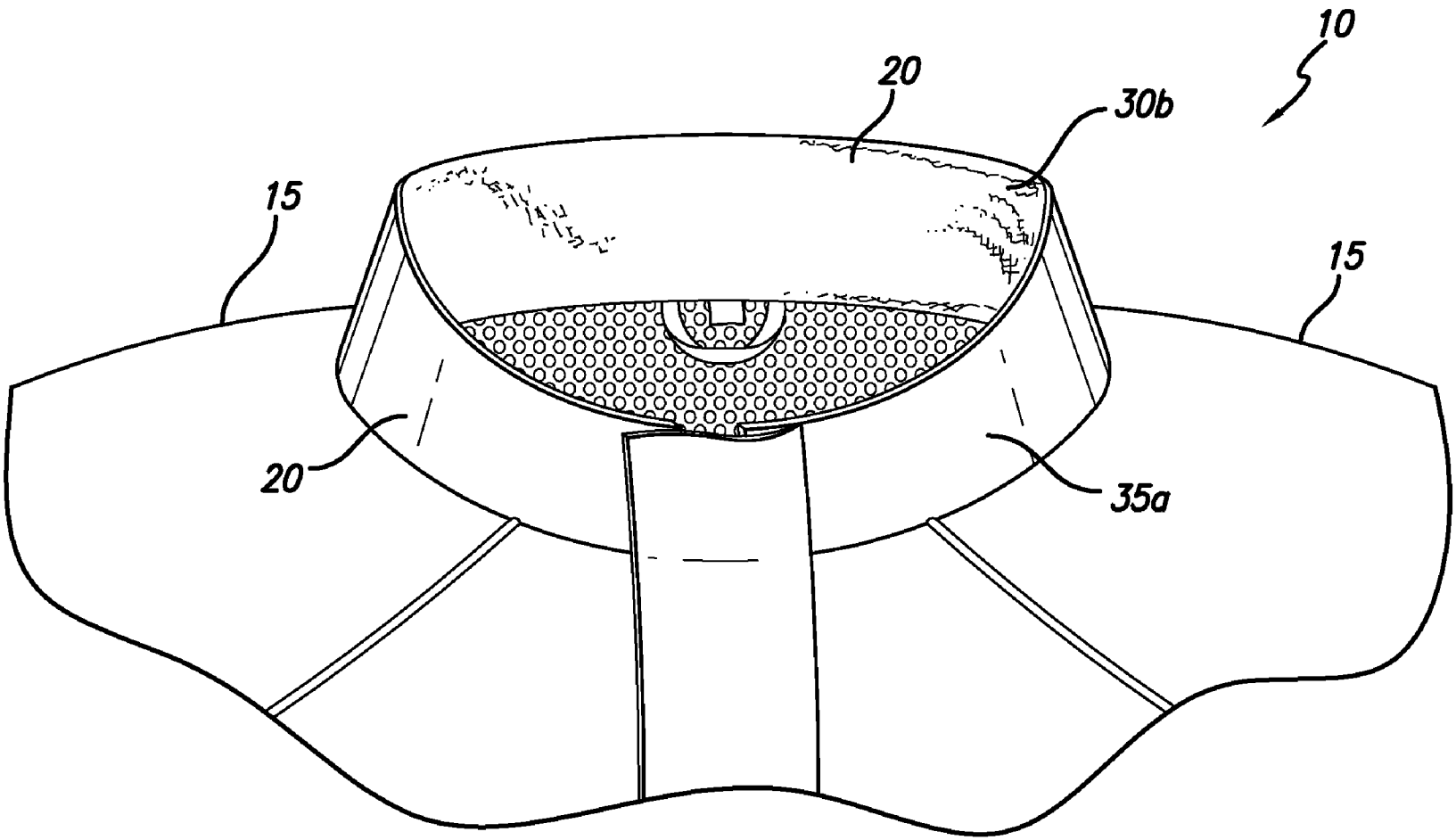
FIG. 1 is a front plan view of the garment showing the collar in a first closed configuration in accordance with a preferred embodiment of the invention.

As shown in the drawings, for purposes of illustration, the invention is embodied in a garment that includes a deployable hood. In a preferred embodiment, and in the exemplary description below, the invention comprises a garment having a main body portion, a hood attached to the main body portion, and a collar defining a collar pocket attached to the main body portion, the collar having first and second closed configurations and an open configuration.

It will be appreciated that terms such as "front," "back," "top," "bottom," "left," "right," "above," and "side" used herein are merely for ease of description and refer to the orientation of the components as shown in the figures. It should be understood that any orientation of the components described herein is within the scope of the present invention.

As shown in FIGS. 1-11, generally, the garment 10 includes a main body portion 15, a collar 20, and a hood 25. As best shown in FIG. 5B, the hood 25 is preferably received in the collar pocket 20*a* when not in use. In this position, the hood 25 is in the non-deployed position and the collar is in the first closed configuration.

Figure 2:
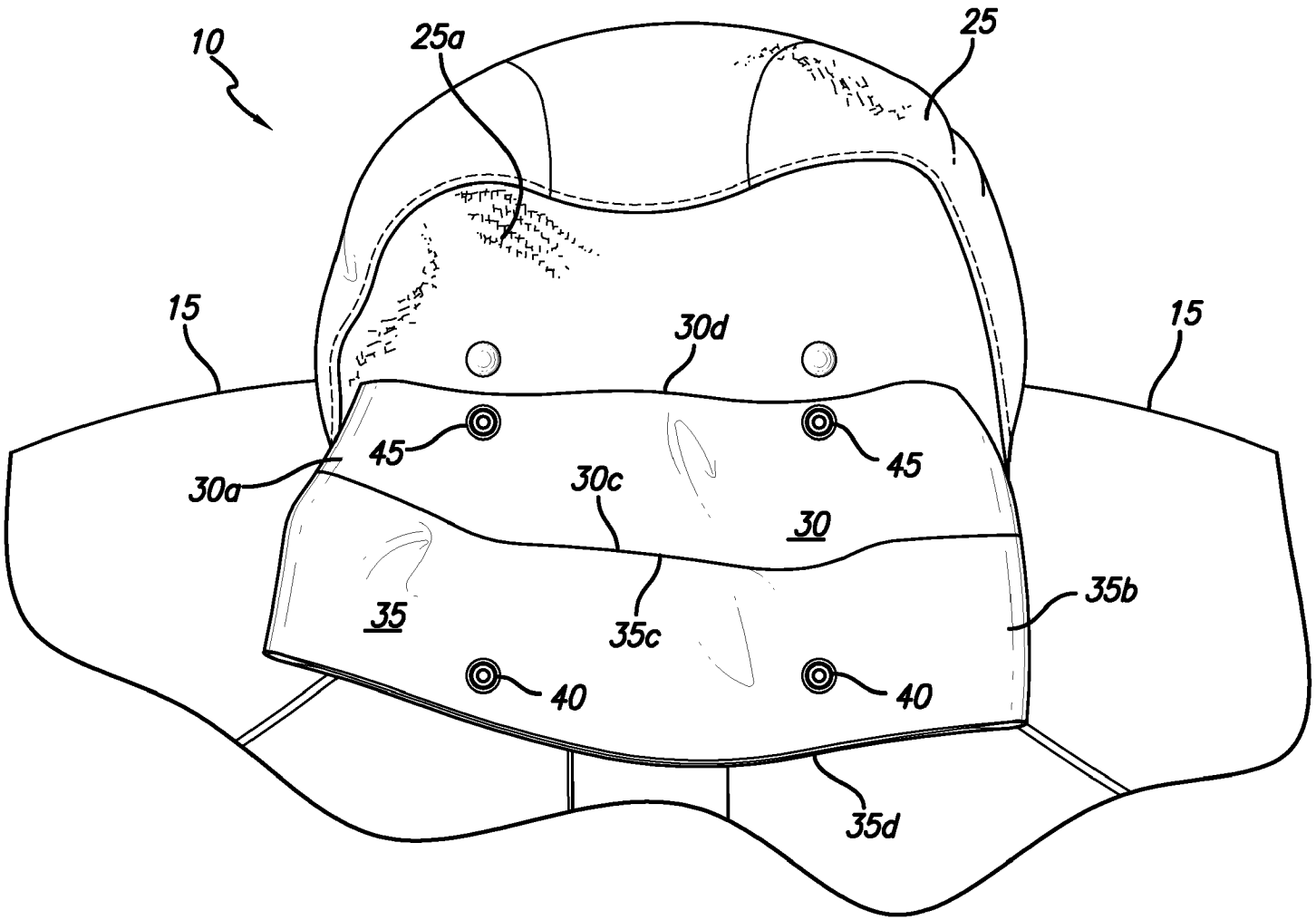
FIG. 2 is a front plan view of the garment of FIG. 1 with hood exposed and showing the collar in an open configuration.
Figure 3:
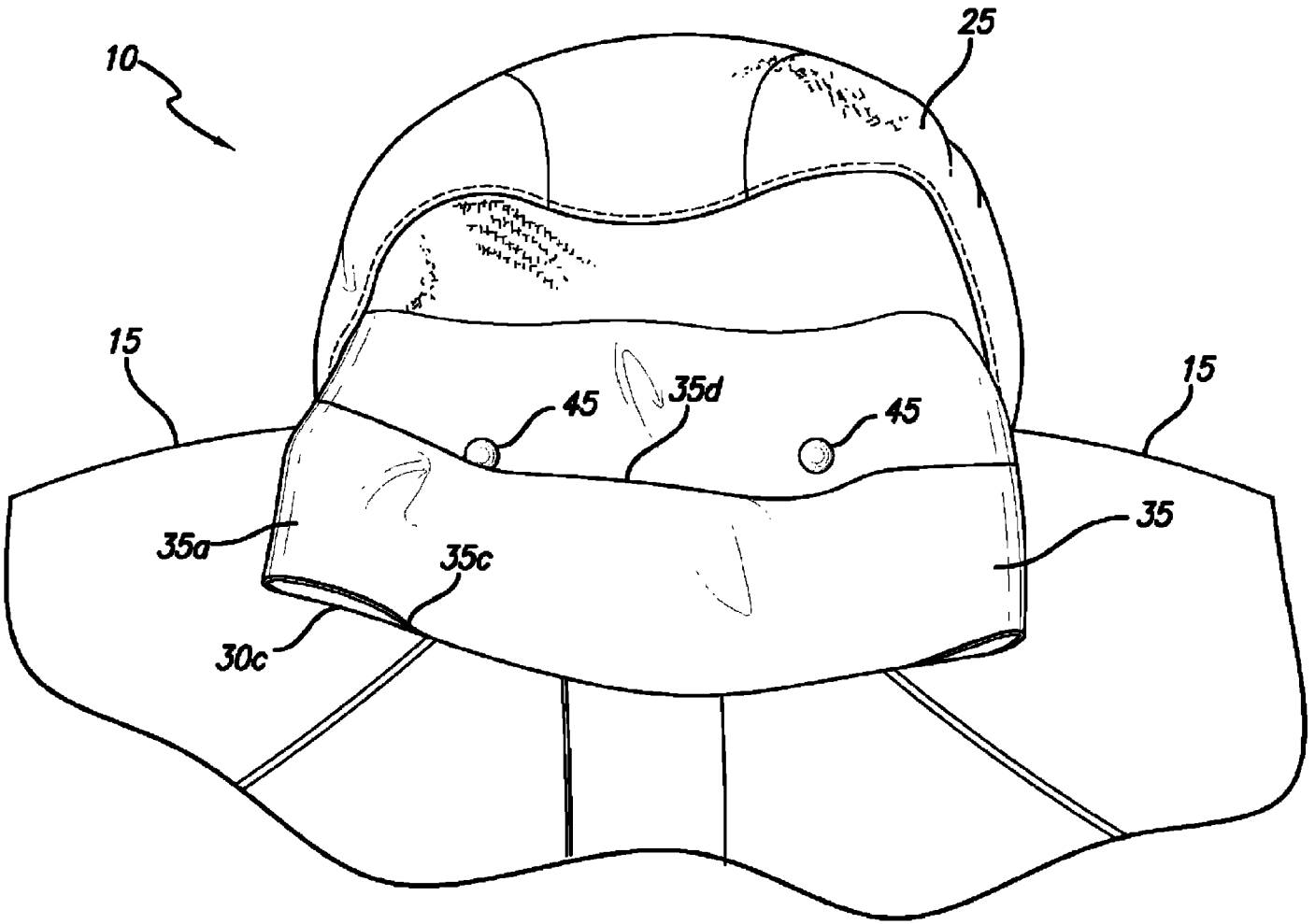
FIG. 3 is a front plan view of the garment of FIG. 1 with the hood deployed and showing the collar in the second closed configuration, but with the collar facing down to expose the fasteners.
Figure 4:
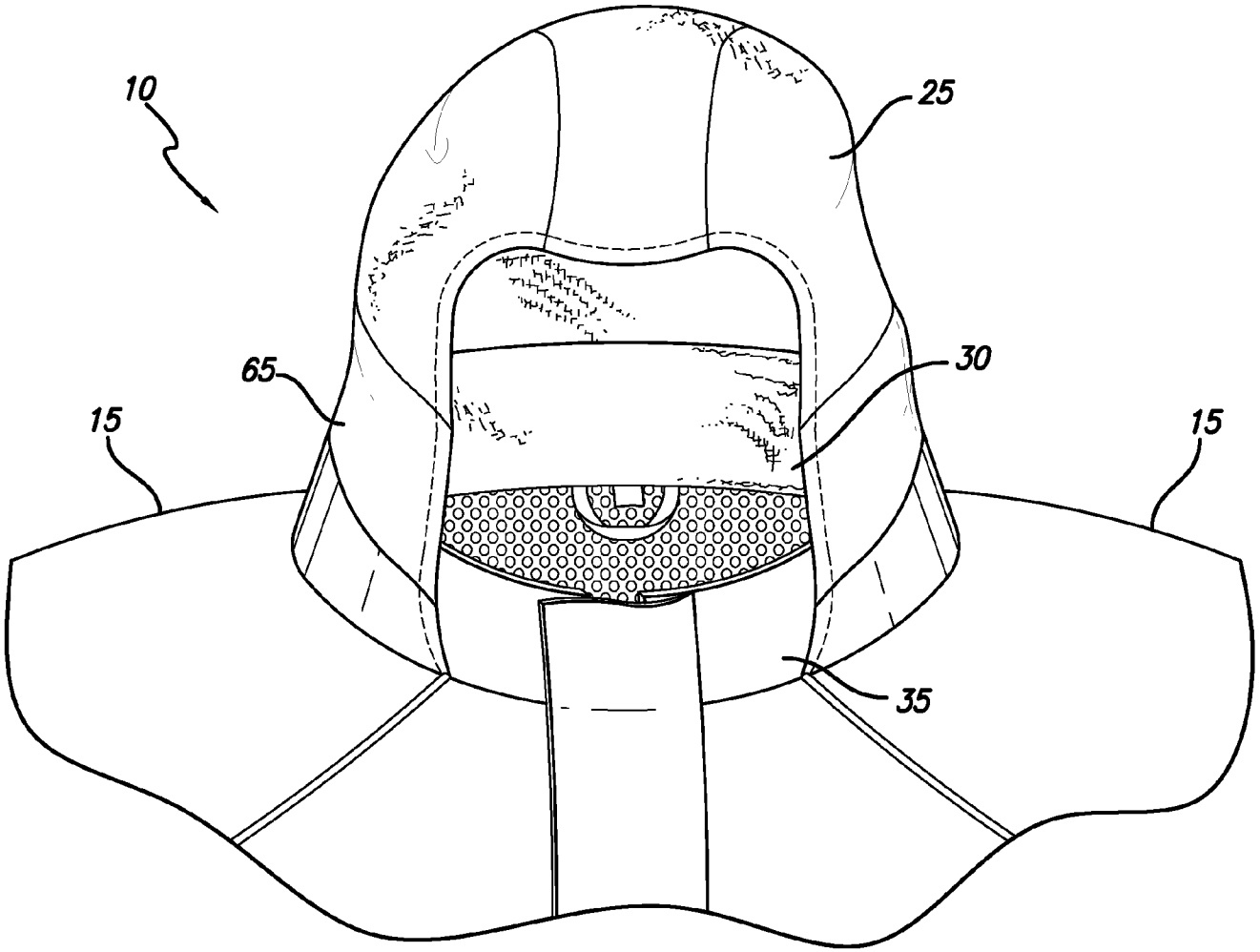
FIG. 4 is a front plan view of the garment of FIG. 1 with the hood deployed and showing the collar in the second closed configuration.
Figure 6:
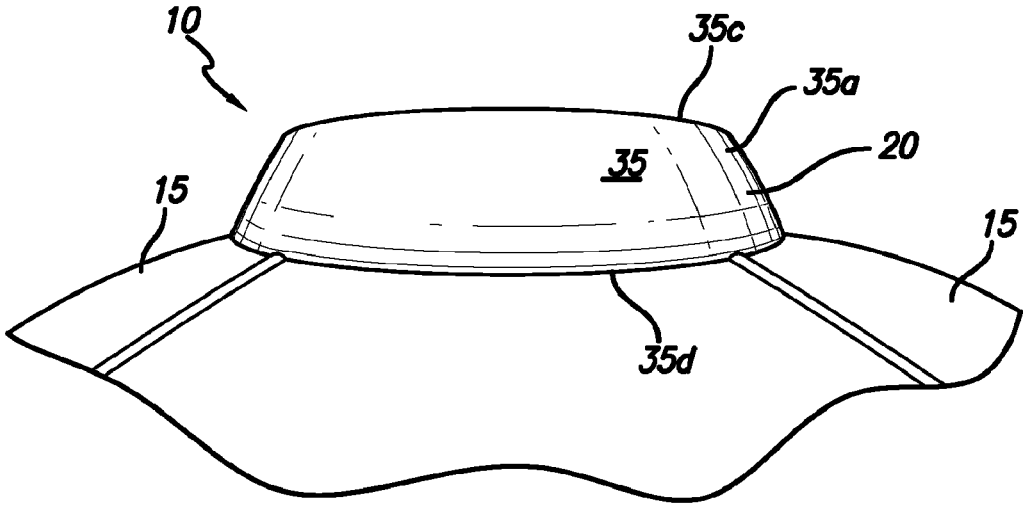
FIG. 6 is a back plan view of the garment of FIG. 1 with the hood in the collar pocket.
Figure 7:
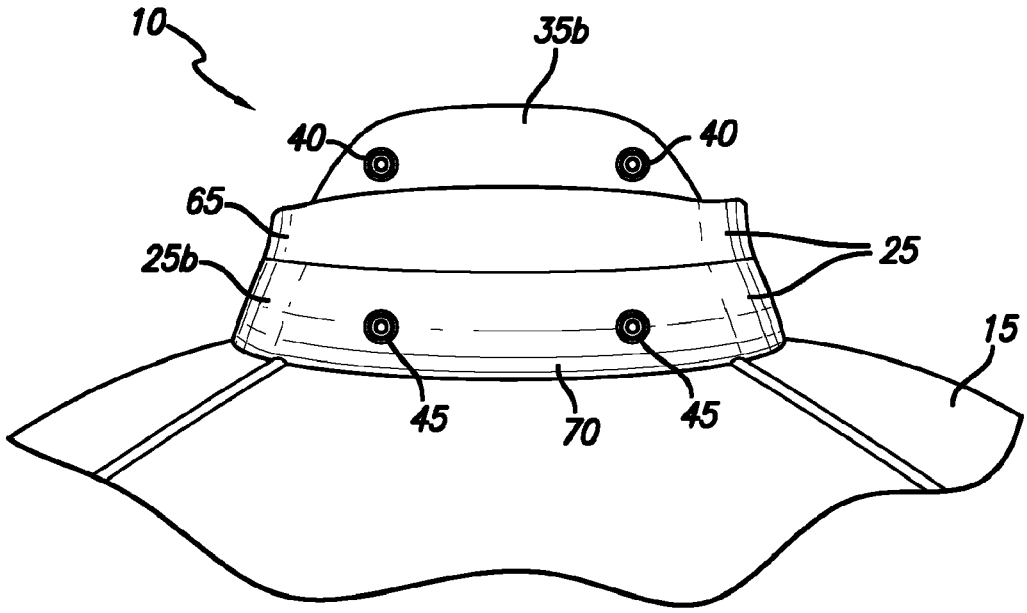
FIG. 7 is a back plan view of the garment of FIG. 1 with the hood exposed and showing the collar in the open configuration.
Figure 8:
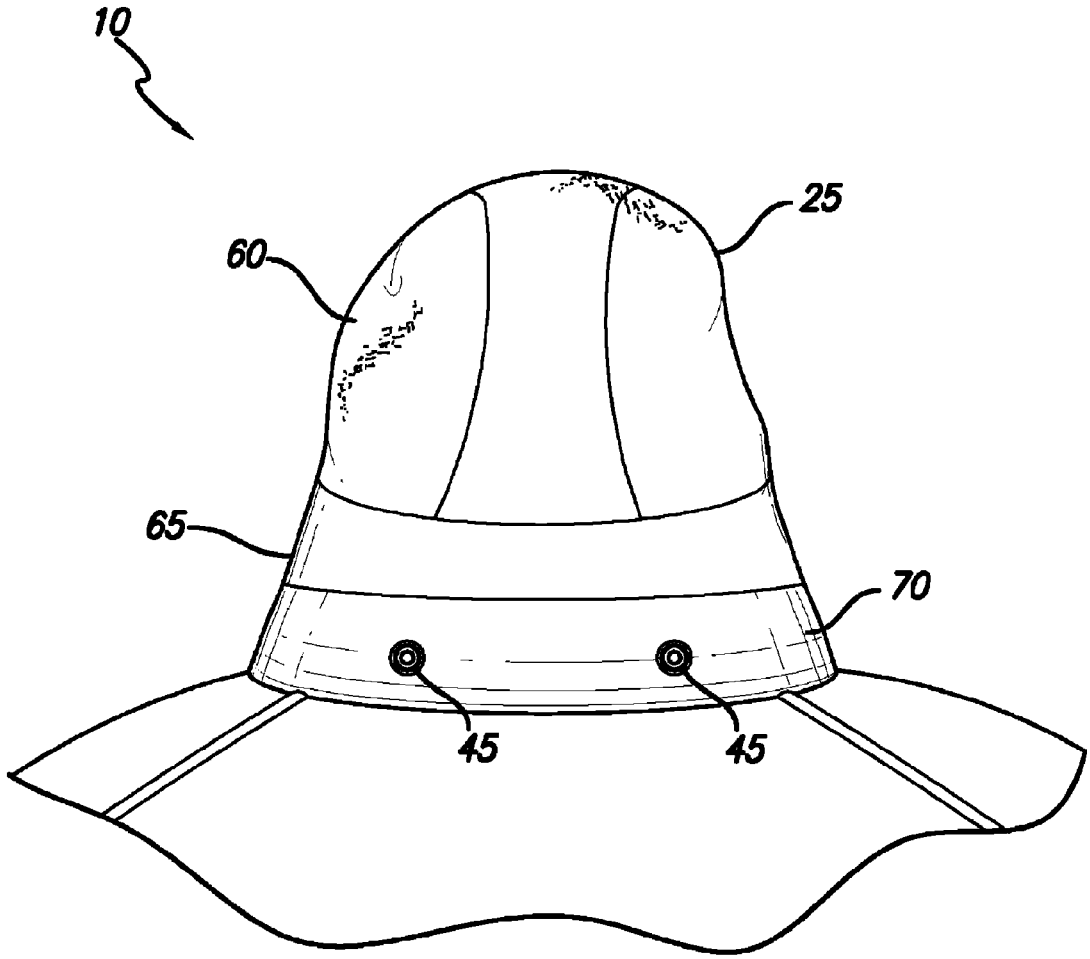
FIG. 8 is a back plan view of the garment of FIG. 1 with the hood deployed and showing the collar in the second closed position.

FIGS. 1-4 generally show the deployment of the hood as viewed from the front: the hood 25 is received in the collar 20 (FIG. 1), exposed as the collar flaps are opened by the user (FIG. 2), and deployed (FIGS. 3 and 4). FIGS. 6-8 generally show the deployment of the hood as viewed from the back.

Figure 9:
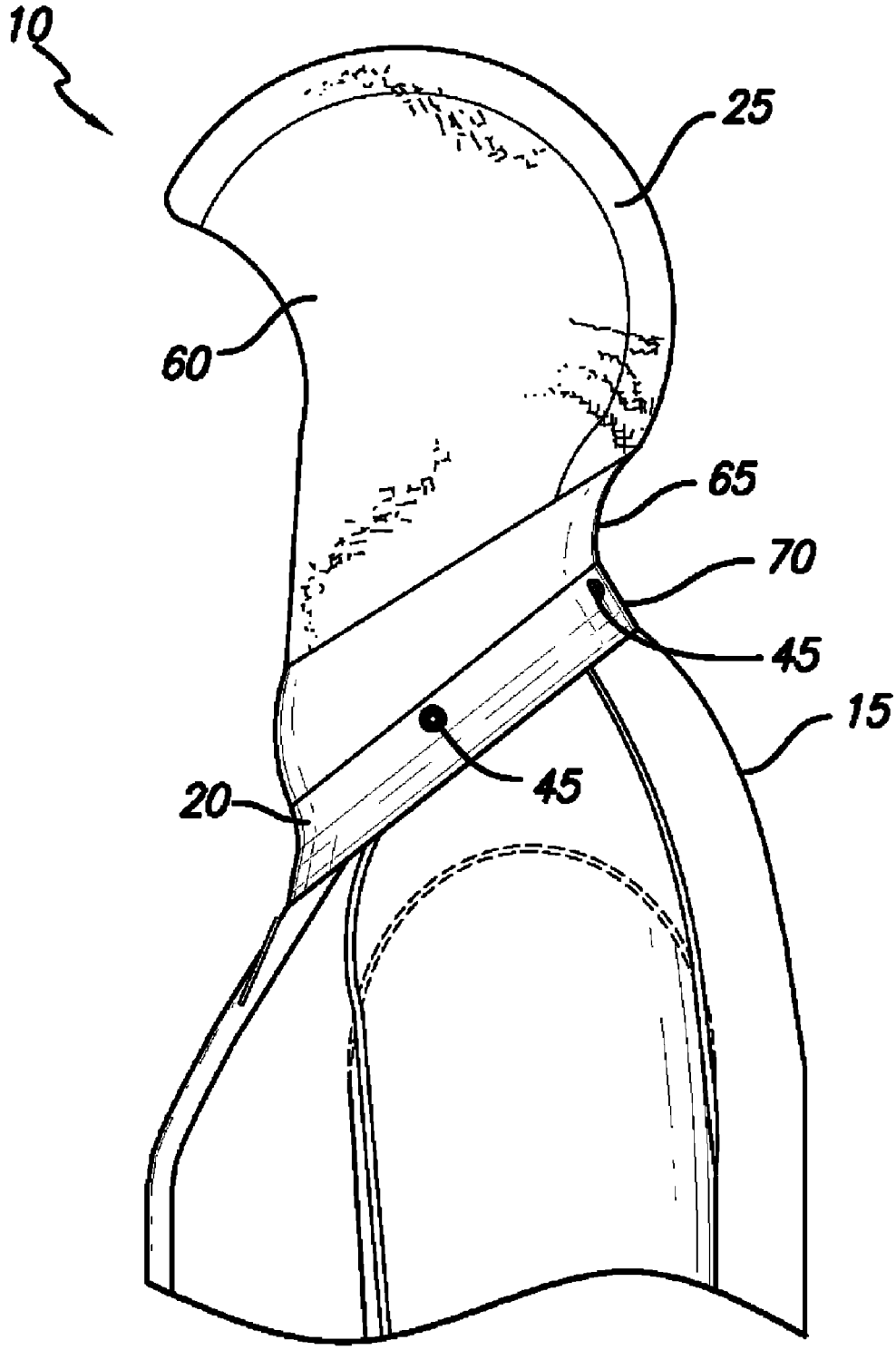
FIG. 9 is a side view of the garment of FIG. 1 with the hood deployed.
Figure 10:
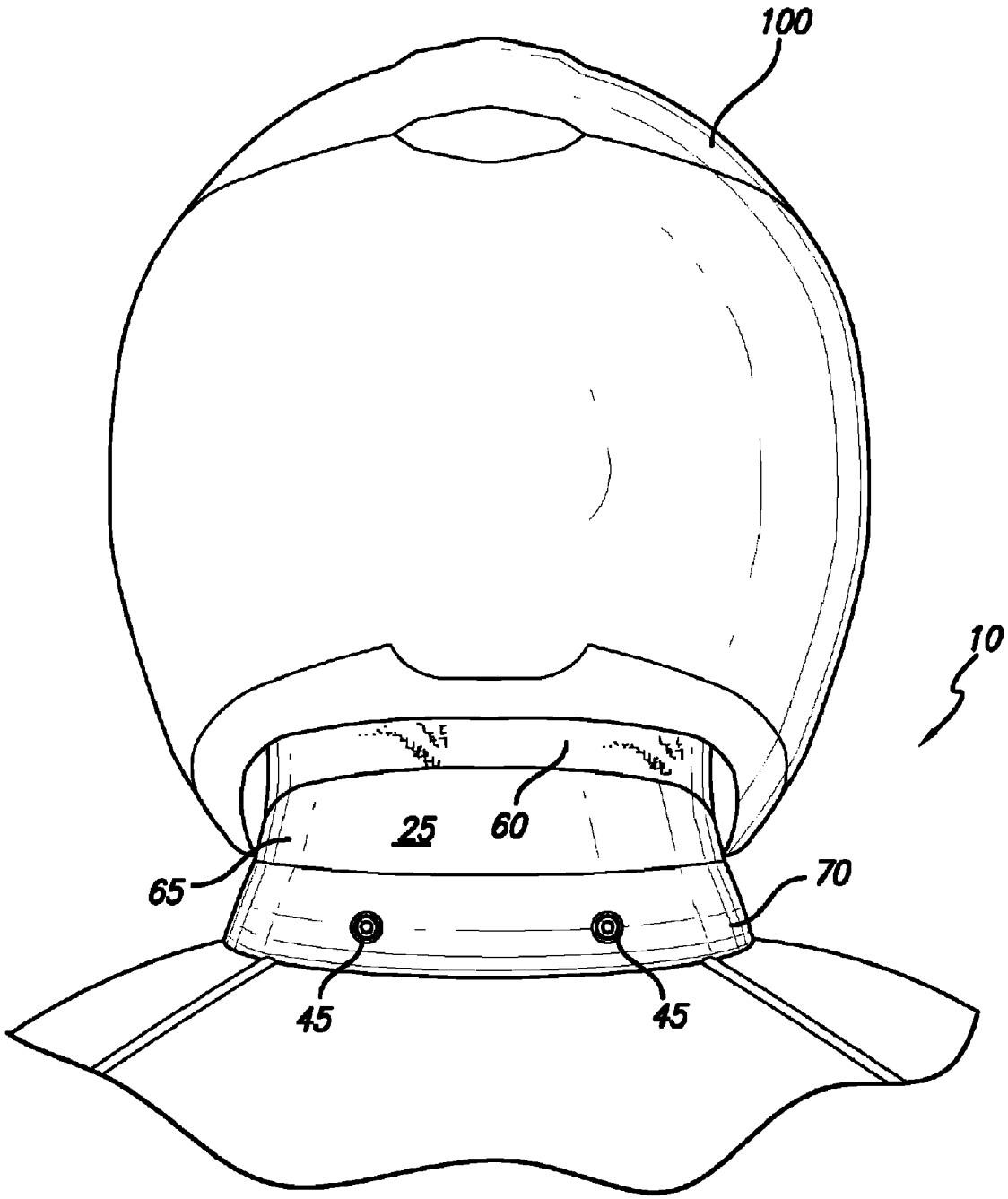
FIG. 10 is a back plan view of the garment of FIG. 1 as worn by an individual with the hood deployed and a helmet worn over the hood.
Figure 11:
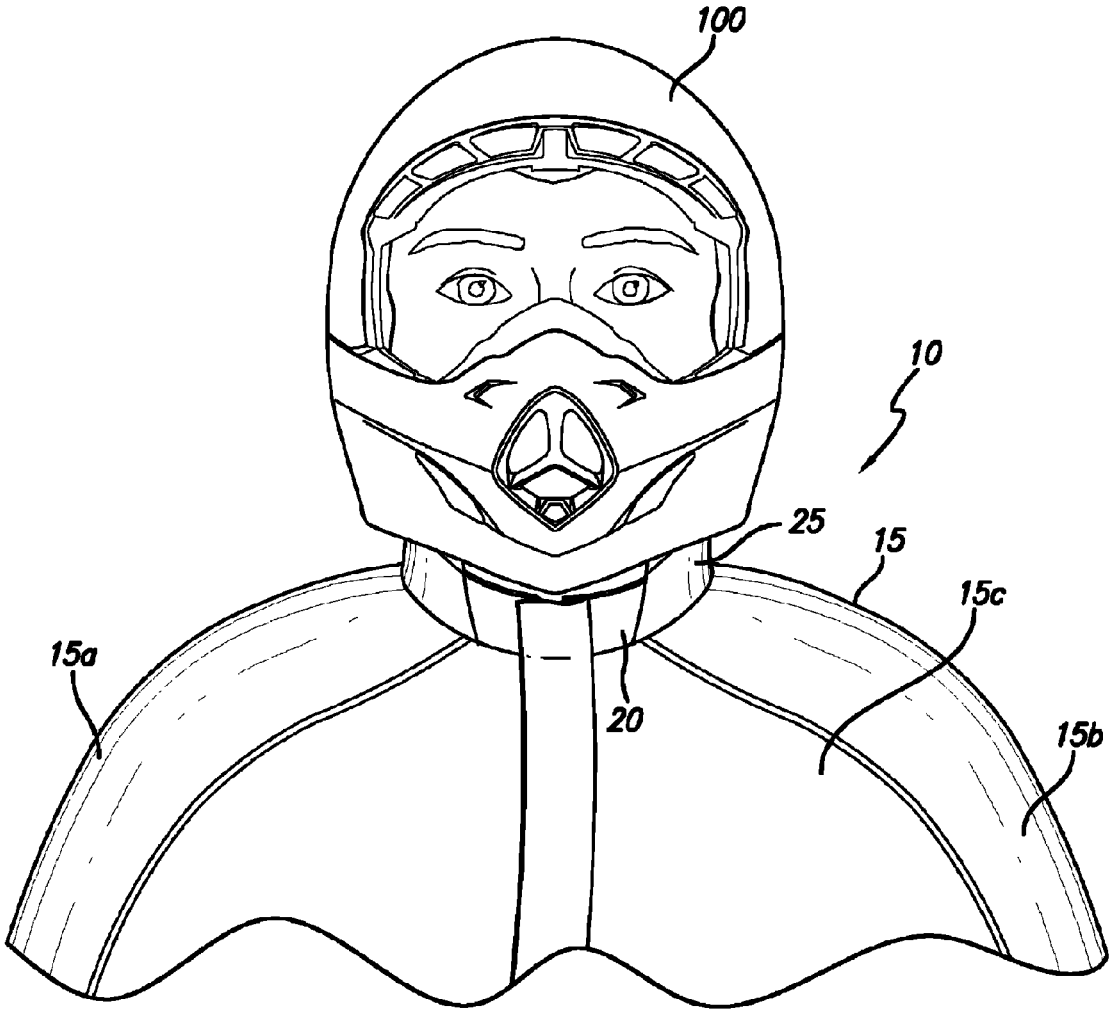
FIG. 11 is a front plan view of the garment of FIG. 1 as worn by an individual with the hood deployed and a helmet worn over the hood.

As shown in FIG. 1, the hood (not shown) is generally received within the collar 20 of the main body portion 15 when not in use by the individual. As such, the individual may easily move around without having a hood dangling in the way and hindering movement. This may be especially important if the individual is riding a motorcycle, bicycle, skiing, or the like, as the individual may not be able to remove his hands from the handlebar to push the hood away when riding. As shown in FIGS. 9-11, the hood 25 may be worn alone (FIG. 9) or may be worn under a helmet 100, such as a motorcycle or bicycle helmet 100, or the like (as shown in FIGS. 10-11). As shown in FIG. 11, preferably the main body portion 15 is a jacket comprising a torso portion 15*c* and arms 15*a* and 15*b*. The jacket can be any jacket known in the art and may include pockets, zippers, a liner, waterproof material, etc. The type of jacket or garment is not a limitation on the present invention. For example, it is understood that the main body portion 15 may be any other type of garment worn on a person's torso, such as a vest, suit, t-shirt, sweatshirt, or the like, without departing from the scope of the present invention.

As shown in FIG. 2, in a preferred embodiment, the collar 20 comprises first flap 30 and second flap 35. First flap 30 includes first side 30*a* and second side 30*b* (not shown in FIG. 2, but shown in FIG. 1). Second flap 35 includes first side 35*a* (not shown in FIG. 2, shown in FIG. 1) and second side 35*b*. The first flap 30 and the second flap 35 each include top (30*c* and 35*c*) and bottom (30*d* and 35*d*) edges.

As shown in FIGS. 2 and 3, in a preferred embodiment, the top edge 30*c* of first flap 30 is attached to the top edge 35*c* of second flap 35. Preferably, the top edges 30*c* and 35*c* are attached together, and the bottom edge 30*d* of the first flap 30 is attached to the main body portion 15. The hood 25 is also preferably attached to the main body portion 15 adjacent to the first flap 30. Preferably top edges 30*c* and 35*c* are attached together by sewing, Velcro closures, button closure, or the like. It will be understood that the flaps 30, 35 can be made of a number of layers of material. For example, first flap 30 can be made of layers that include an outer waterproof layer and an inner layer that is comfortable against a user's neck.

The bottom edge 35*d* of the second flap 35 is removably coupled to the first flap 30 at or near its bottom edge 30*d* (in the second closed configuration or deployed position) and to the hood 25 (in the first closed configuration or non-deployed position), as will be described below.

Figure 5B:
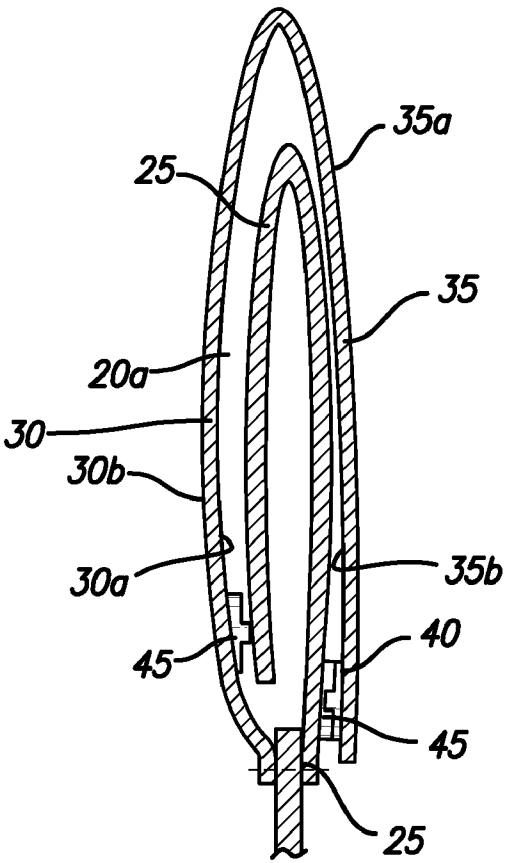
FIG. 5B is a cross-sectional side elevational view of the garment of FIG. 1 showing the collar in the first closed configuration.
Figure 5A:
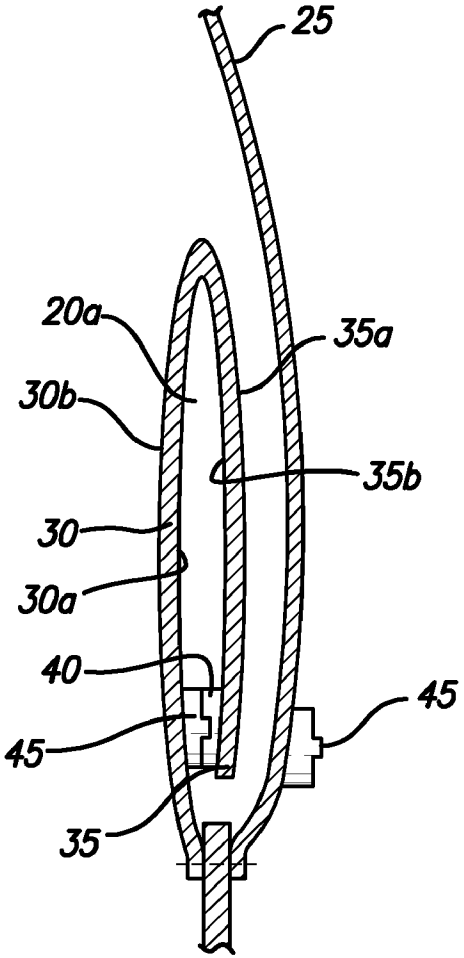
FIG. 5A is a cross-sectional side elevational view of the garment of FIG. 1 showing the collar in the second closed configuration.

In a preferred embodiment, the first side 30*a* of the first flap 30 and the second side 35*b* of the second flap 35 each include at least one fastener as shown in FIGS. 2, 5A and 5B. In a preferred embodiment, as best shown in FIGS. 5A and 5B, the second side 35*b* of the second flap 35 comprises at least one female fastener 40, and the first side 30*a* of the first flap 30 comprises at least one male fastener 45. In the most preferred embodiment, the first side 30*a* of the first flap includes four male fasteners 45, and the second side 35*b* of the second flap 35 includes four corresponding female fasteners 40. It should be understood that although most of the figures only show two fasteners, the sides of the flaps and hood each include a fastener (see FIG. 9), bringing the total in the most preferred embodiment to four. However, the number of fasteners is not a limitation on the invention. Preferably, these fasteners are buttons or snaps, however, they can be any known closure member or fastener, such as Velcro, zippers, clasps or the like.

The terms "male" and "female" as used herein are not intended to be limiting. It will be understood that the second side 35*b* of the second flap 35 may include at least one male fastener, and the first side 30*a* of the first flap 30 may include at least one female fastener 40, without departing from the scope of the present invention. Accordingly, as used in the claims, male and female can be used interchangeably. In other words, any type of fastener that includes two corresponding members that are removably coupled to one another is within the scope of the claims.

In a preferred embodiment, the first flap 30 and the second flap 35 define a collar pocket 20*a*, as best shown in FIGS. 5A and 5B. Preferably, the hood 25 is attached to the main body portion 15 (or the hood 25, first flap 30 and main body portion 15 can all be stitched together) and comprises first and second sides 25*a* and 25*b*. As shown in FIG. 7, the second side 25*b* generally comprises at least one fastener. As best shown in FIGS. 5A and 5B, preferably the fastener is at least one male fastener 45. However, the second side 25*b* may include at least one female fastener 40, without departing from the scope of the present invention.

The hood 25 is preferably attached to the main body portion 15 by sewing. In addition, the hood may be attached to the collar or may be detachable or may be attached to the main body portion 15 by other means known in the art, without departing from the scope of the present invention.

As best shown in FIG. 8, the hood 25 generally comprises a head portion 60, neck portion 65, and bottom portion 70. In a preferred embodiment, the head portion 60 is comprised of a stretchable material, such as nylon, lycra, lycia or the like or a blend thereof. In a preferred embodiment, the neck portion 65 is also stretchable, but is also waterproof. The neck portion 65 can also be a breathable material, however this is not a limitation on the present invention. For example, it may be comprised of nylon, lycra, lycia, polyester or the like or a blend thereof. Preferably, head portion 60 and neck portion 65 are comprised of different materials. However, this is not a limitation on the present invention. Bottom portion 70 and main body portion 15 are preferably comprised of the same or a similar material.

The main body portion 15 may be comprised of any material known in the art, such as nylon, polyester, or the like. Preferably, the at least one male fastener 45 of the hood 25 is located on the bottom portion 70. In another embodiment, head portion 60 and neck portion 65 may be comprised of the same or similar material without departing from the scope of the present invention. Any or all of the hood 25 and/or the main body portion 15 may be comprised of fire-retardant material or water-proof material.

As indicated earlier, the inventive hood 25 is removable or deployable from the collar pocket 20*a* for use by an individual, and can be pushed back into the collar pocket 20*a* when not in use by the individual. The following provides a discussion on the deployment of the hood 25.

Generally, the hood is moveable between a non-deployed position where it is received within the collar pocket and a deployed position where it is not received within the collar pocket. The hood may be pushed back into the collar pocket (and the fasteners closed) when not in use.

FIG. 5B shows the hood in the non-deployed position and the collar in the first closed configuration, where second flap 35 is removably coupled to hood 25. To expose the hood 25, the second flap 35 and hood 25 are preferably disengaged from each other by disengaging the male fasteners 45 on the second side 25*b* of the hood 25 (shown in FIG. 7) from the female fasteners 40 on the second flap 35. Disengaging the fasteners opens up the collar pocket (this is the open configuration, best shown in FIG. 2). The hood 25 is then removed from the collar pocket 20*a*.

As shown in FIG. 5A, the collar pocket 45*a* is closed after the hood 25 is deployed by coupling first flap 30 to the second flap 35 by engaging the male fastener 45 to the female fastener 40. In this configuration, the collar 20 is in the second closed configuration and the hood is in the deployed position.

Referring to FIGS. 8-11, after the hood 25 is deployed, it can be stretched so as to cover the user's head. In a preferred embodiment, a helmet 100 is worn over the hood 25. Preferably, due to the stretchable material of the hood 25 it does not obstruct the individual's line of sight as the individual turns his/her head from one side to another. It also minimally limits restriction of movement.

The foregoing embodiments are merely examples of the present invention. Those skilled in the art may make numerous uses of, and departures from, such embodiments without departing from the spirit and the scope of the present invention. Accordingly, the scope of the present invention is not to be limited to or defined by such embodiments in any way, but rather, is defined solely by the following claims.

What is claimed is:

1. A garment comprising:

(a) a main body portion, (b) a collar attached to the main body portion, wherein the collar includes a first flap that forms the front of the collar and has a front side and a back side and a second flap that forms the back of the collar and has a front side and a back side, wherein the first and second flaps define a collar pocket and each include a top edge and a bottom edge, wherein the top edges are permanently attached together, and (c) a hood attached to the main body portion adjacent to the collar and having a front side and a back side, wherein the hood is movable between a non-deployed position where it is received within the collar pocket and a deployed position where it is not received in the collar pocket and it extends above the first and second flaps to cover a user's head, wherein the back side of the first flap includes at least one male fastener adjacent the bottom edge, the front side of the second flap includes at least one female fastener adjacent the bottom edge and the back side of the hood includes at least one male fastener adjacent the bottom edge, and wherein the at least one female fastener of the second flap is removably coupled to the at least one male fastener of the first flap in the deployed position and the at least one female fastener of the second flap is removably coupled to the at least one male fastener of the hood in the non-deployed position.

2. The garment of claim 1, wherein the hood comprises a head portion and a neck portion, and wherein the head portion is comprised of a first material and the neck portion is comprised of a second material.

3. The garment of claim 2, wherein the first material is stretchable.

4. The garment of claim 2 wherein at least a portion of the hood is waterproof.

5. The garment of claim 4 wherein at least a portion of the hood is stretchable.

* * * * *